US010153536B2

(12) United States Patent
Gritters et al.

(10) Patent No.: US 10,153,536 B2
(45) Date of Patent: Dec. 11, 2018

(54) MAGIC-Y SPLITTER

(71) Applicant: Raytheon Company, Waltham, MA (US)

(72) Inventors: Darin M. Gritters, Yucaipa, CA (US); Kenneth W. Brown, Yucaipa, CA (US); David D. Crouch, Eastvale, CA (US)

(73) Assignee: Raytheon Company, Waltham, MA (US)

( * ) Notice: Subject to any disclaimer, the term of this patent is extended or adjusted under 35 U.S.C. 154(b) by 5 days.

(21) Appl. No.: 15/388,244

(22) Filed: Dec. 22, 2016

(65) Prior Publication Data

US 2018/0183129 A1 Jun. 28, 2018

(51) Int. Cl.
*H01P 5/20* (2006.01)
*H01P 5/19* (2006.01)
*H01P 5/18* (2006.01)

(52) U.S. Cl.
CPC ..... *H01P 5/19* (2013.01); *H01P 5/181* (2013.01); *H01P 5/20* (2013.01)

(58) Field of Classification Search
CPC ..... H01P 5/20
USPC ..... 333/122
See application file for complete search history.

(56) References Cited

U.S. PATENT DOCUMENTS 2,689,942 A * 9/1954 Zaleski ..... H01P 5/20 333/122
2,840,787 A 6/1958 Adcock et al.
2,849,688 A 8/1958 Ayers et al.
3,201,715 A * 8/1965 Breese ..... H01P 1/161 333/1.1
3,375,472 A * 3/1968 Walker ..... H01P 5/20 333/122
4,383,189 A * 5/1983 D'Oro ..... H01P 5/12 327/100
4,413,242 A * 11/1983 Reeves ..... H01P 5/20 333/122
4,812,789 A * 3/1989 Lee ..... H01P 1/182 333/135
4,956,622 A * 9/1990 de Ronde ..... H01P 5/02 333/125

(Continued)

OTHER PUBLICATIONS

PCT International Search Report and Written Opinion dated Dec. 11, 2017 for International Application No. PCT/US2017/055221; 15 Pages.

(Continued)

*Primary Examiner* — Dean Takaoka
(74) *Attorney, Agent, or Firm* — Daly, Crowley, Mofford & Durkee

(57) ABSTRACT

In one aspect, a Y-splitter includes a first arm having a first port, a second arm having a second port, a third arm having a third port, a fourth arm having a fourth port and a Y-split portion having a first end coupled to the first arm, a second end coupled to the second arm, a third end coupled to the third arm and a fourth end coupled to the fourth arm. The Y-split portion splits a signal from a first signal path from the first port into a second signal on a second signal path and a third signal on a third signal path. A first angle between the second signal path and the first signal path is greater than 90 degrees and a second angle between the third signal path and the first signal path is greater than 90 degrees.

17 Claims, 7 Drawing Sheets

(56) References Cited

U.S. PATENT DOCUMENTS

| | | | | |
|---|---|---|---|---|
| 5,329,285 | A * | 7/1994 | McCandless | G01S 7/024 333/115 |
| 7,019,603 | B2 * | 3/2006 | Yoneda | H01P 1/161 333/122 |
| 7,408,427 | B1 * | 8/2008 | Lee-Yow | H01P 1/161 333/126 |
| 8,107,894 | B2 | 1/2012 | Lowell et al. | |
| 9,362,609 | B2 | 6/2016 | Brown et al. | |
| 9,373,880 | B2 * | 6/2016 | Tatomir | H01P 3/12 |
| 2014/0232483 | A1 | 8/2014 | Correa et al. | |
| 2014/0312988 | A1 | 10/2014 | Lee | |
| 2015/0280650 | A1 | 10/2015 | Brown et al. | |

OTHER PUBLICATIONS

Kahn; "E-Plane Forked Hybrid-T Junction"; IRE Transactions—Microwave Theory and Technique; Dec. 1, 1955; 4 Pages.

* cited by examiner

MAGIC-Y SPLITTER

GOVERNMENT RIGHTS

This invention was made with U.S. Government support under contract number M67854-08-7027 awarded by the Department of Defense. The U.S. Government has certain rights in the invention.

BACKGROUND

Referring to FIG. 1, a typical magic-T splitter 10 is a four-port splitter having a first port 12, a second port 14, a third port 16 and a fourth port 18. The magic-T splitter 10 has a single input port, port 12 that divides the input power equally into two right-angle ports relative to the input port. In one example, arms 20, 22, 24 of the magic-T splitter 10 form a tee in the H-plane and the port 12 is also called an H-Plane port or sum (Σ) port.

A waste arm 26 is connected to the arms 20, 22, 24 at one end and includes a fourth port 18 at the opposite end. The fourth port 18 is a waste port to handle the reflected power that may come back to the splitter 10. The fourth port 18 forms an E-plane tee with the arms 22, 24. The fourth port 18 is sometimes called a difference (Δ) port. The magic-T splitter 10 can be used as a power combiner or a power divider.

SUMMARY

In one aspect, a Y-splitter includes a first arm having a first port, a second arm having a second port, a third arm having a third port, a fourth arm having a fourth port and a Y-split portion having a first end coupled to the first arm, a second end coupled to the second arm, a third end coupled to the third arm and a fourth end coupled to the fourth arm. The Y-split portion splits a signal from a first signal path from the first port into a second signal on a second signal path and a third signal on a third signal path. A first angle between the second signal path and the first signal path is greater than 90 degrees and a second angle between the third signal path and the first signal path is greater than 90 degrees.

In another aspect, a Y-splitter includes a first arm having an input port, a second arm having a first output port, a third arm having a second output port, a fourth arm having a waste port and a Y-split portion. The Y-split portion having a first end coupled to the first arm, a second end coupled to the second arm, a third end coupled to the third arm and a fourth end coupled to the fourth arm, a post disposed inside the Y-split portion. The second arm, third arm and the Y-split portion form a step. The Y-split portion splits a signal from a first signal path from the input port into a second signal on a second signal path and a third signal on a third signal path. A first angle between the second signal path and the first signal path is greater than 90 degrees. A second angle between the third signal path and the first signal path is greater than 90 degrees. The first, second and third signal paths are in an E-plane. The fourth arm is in an H-plane and the Y-splitter is fabricated in two pieces split by the E-plane.

In further aspect, a method includes splitting a first signal into a second signal and a third signal using a Y-splitter. The Y-splitter includes a first arm having an input port, a second arm having a first output port, a third arm having a second output port, a waste arm having a waste port a Y-split portion and a post disposed inside the Y-split portion. The Y-split portion having a first end coupled to the first arm, a second end coupled to the second arm, wherein the second arm, the third arm and the Y-split portion form a step, a third end coupled to the third arm and a fourth end coupled to the fourth arm. The method further comprising isolating the second signal from the third signal using the Y-splitter.

DETAIL DESCRIPTION

Figure 1:
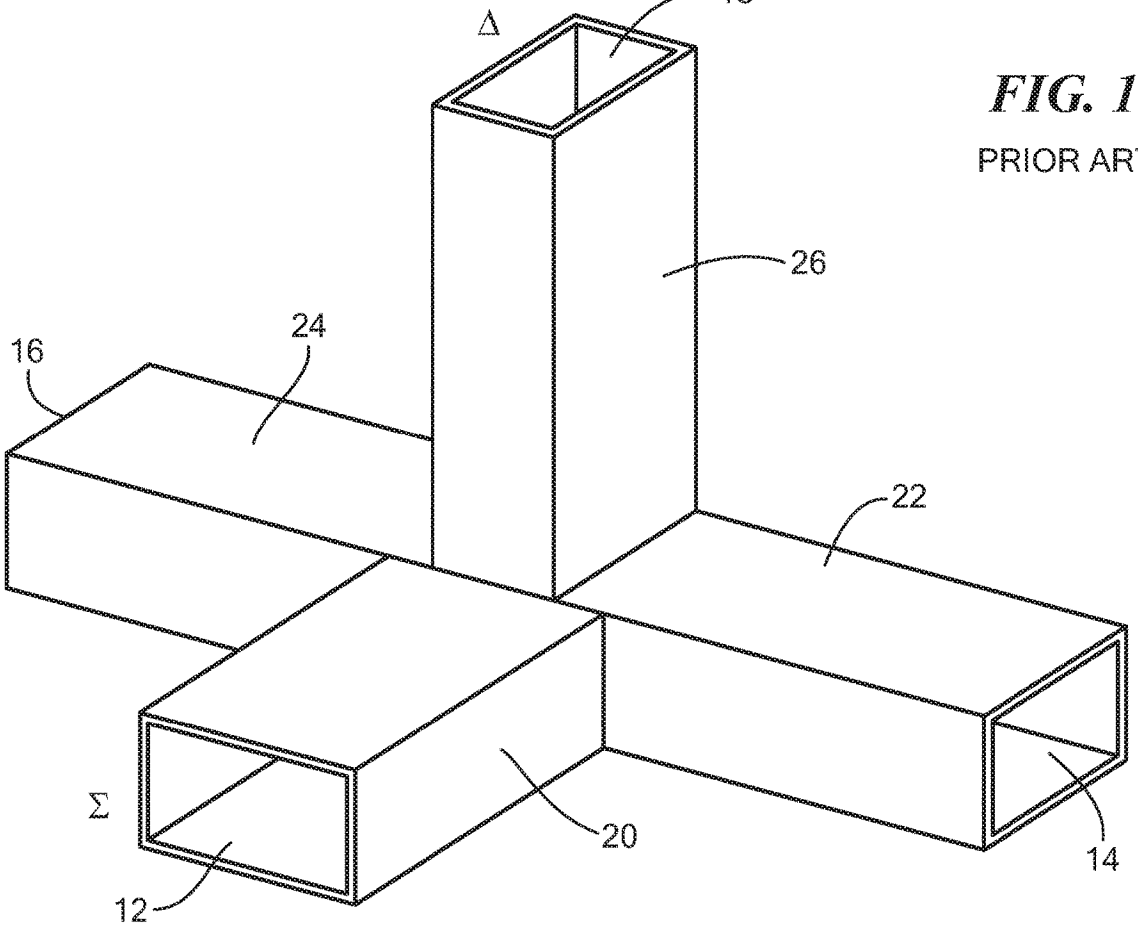
FIG. 1 PRIOR ART
FIG. 1 is a diagram of a magic-T splitter.

Described herein is a magic-Y splitter. Unlike a magic-T splitter, the magic-Y splitter, does not divide the input power from an input port equally into two right angles relative to the input port. Rather, the magic-Y splitter divides the input power from an input port equally into two directions that are initially more than 90° relative to the input port using a Y-split portion (e.g., see Y-split portion 124 (FIG. 2E)). By not splitting an input signal into two right angles, a magic-Y splitter may be fabricated for a specific angle to be more compact to meet area requirements, which allows for a narrower network compared to networks with magic-T splitters.

As will be further described herein, the magic-Y splitter includes other features that enhance the magic Y-splitter to ensure that output ports are electrically isolated from one another. Also, the Y-splitter has a low the return loss at each port (measures the degree of power reflected from each port when used as an input) and a low insertion loss between ports (measures the power lost between the input and output ports).

While the magic-Y splitter may function as a divider as described herein, the magic-Y splitter may also function in the opposite direction as a combiner to combine two in-phase signals into a one signal.

Referring to FIGS. 2A to 2E, a magic-Y splitter 100 includes a post 120, a waste arm 122 having a waste port 118, a Y-split portion 124, an arm 126 having an input port 112, an arm 128 having an output port 114 and an arm 130 having an output port 116. In one plane (i.e., the E-plane), the Y-shaped connector 124 couples the arm 126 to the arms 128, 130. The Y-shaped connector 124 also is coupled to the waste arm 122 in another plane (i.e., the H-plane).

Figure 2B:
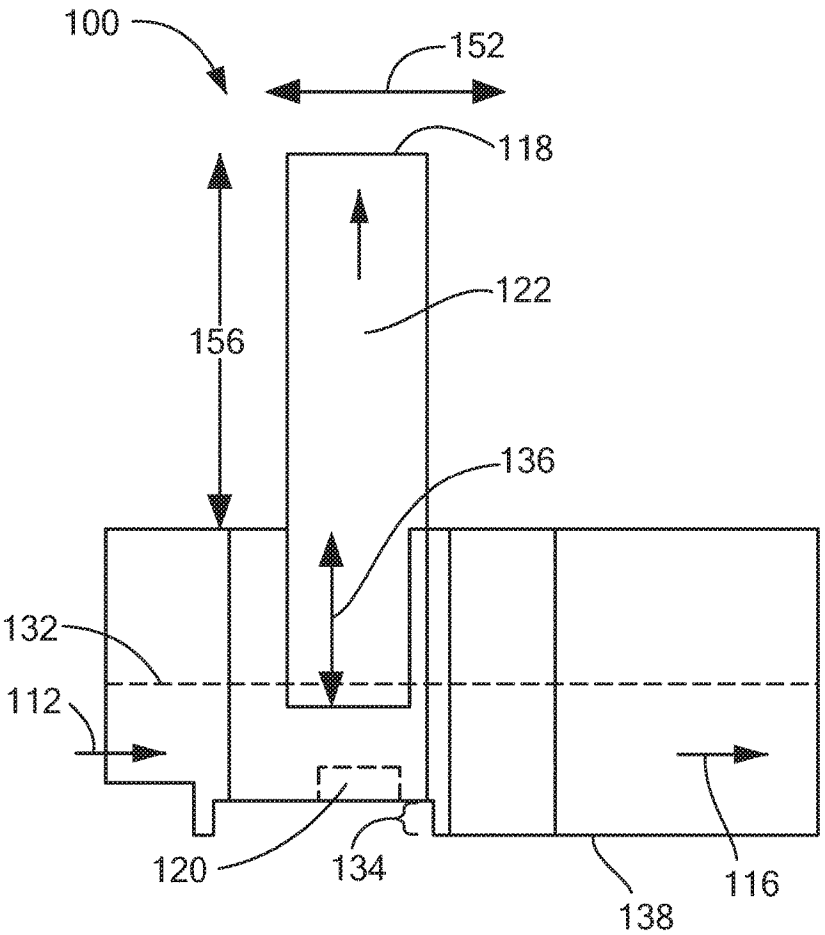
FIGS. 2A to 2D are diagrams of one example of a magic-Y splitter.
Figure 2A:
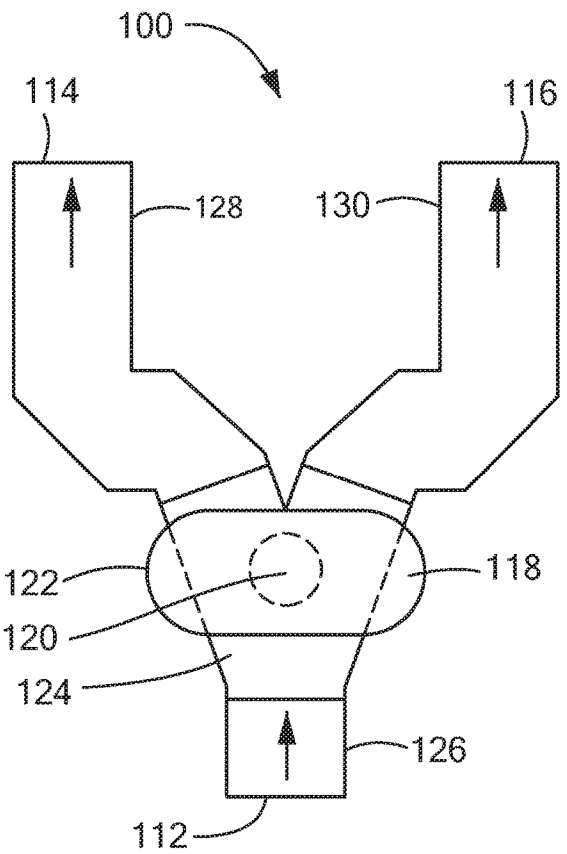

The magic Y-splitter 100 uses an E-plane split so that the magic Y-splitter 100 uses standard machining of two halves to complete the structure, which reduces loss at the interface of the two split structures when placed together if any gaps exist. For example, one portion of the magic-Y splitter 100 may be fabricated for one side of the dotted line 132 and the other portion of the magic-Y splitter 100 may be fabricated for other side of the dotted line 132 as further described in FIG. 6. The E-fields are not parallel to the dotted line 132. In one example the dotted line 132 represents a first plane perpendicular to the plane of the page and the electric fields are primarily parallel to the first plane The Y-split portion 124 includes a first end 162, a second end 164 and a third end 166 (FIG. 2E). The first arm 126 of the magic-Y splitter 100 is coupled to the first end 162, the second arm 128 of the magic-Y splitter 100 is coupled to the second arm 164 and the third arm 130 of the magic-Y splitter 100 is coupled to the third end 166 (FIG. 2E).

The Y-split portion 124 splits a signal from a first signal path 172 from the first port 112 into a second signal on a second signal path 174 and a third signal on a third signal path, 176 (FIG. 2E). A first angle, $\beta_1$, between the second signal path and the first signal path is greater than 90 degrees and a second angle, $\beta_2$, between the third signal path and the first signal path is greater than 90 degrees (FIG. 2E). A split angle, $\alpha$, between the second signal path and the third signal path is less than 180 degrees and more than 10 degrees (FIG. 2E).

In this configuration, the first and second arms 128, 130 are curved such that the signals entering or exiting the second or third ports 114, 116 are parallel to signals exiting or entering the first port 112.

The magic-Y splitter 100 includes several features that may be adjusted to optimize the performance of the magic-Y splitter 100. For example, to electrically isolate the signals from the output ports 114, 116 from each other. In one example, a splitter floor step 134 (formed with the second arm 114, the third arm 116 and the Y-split portion 122) may be raised (as shown in FIG. 2B) or lowered relative to a bottom 138 of the magic-Y splitter 100 to match to the split angle, $\alpha$, (FIG. 2E) desired.

In one example, lowering the splitter floor step 134 may cause overmoding at higher frequencies and thus limiting usable bandwidth. Overmoding can occur in waveguides when operated at a frequency above the cutoff frequency of any mode or modes above the fundamental mode. When this occurs, energy is lost from the fundamental mode (e.g., the TE10 mode in rectangular waveguide) and is coupled into undesired higher-order modes. To counter act overmoding, the post 120 may be added in the center of the Y-split portion 124 to prevent the higher order modes from being excited.

Other features may affect performance of the magic-Y splitter. For example, a waste port depth 136 may be adjusted to control performance. In another example, a location of the waste arm 122 along the line 152 may control performance. In a further example, a width 154 of the waste arm 122 and/or a height 156 of the waste arm 122 may also control the performance.

Figure 2C:
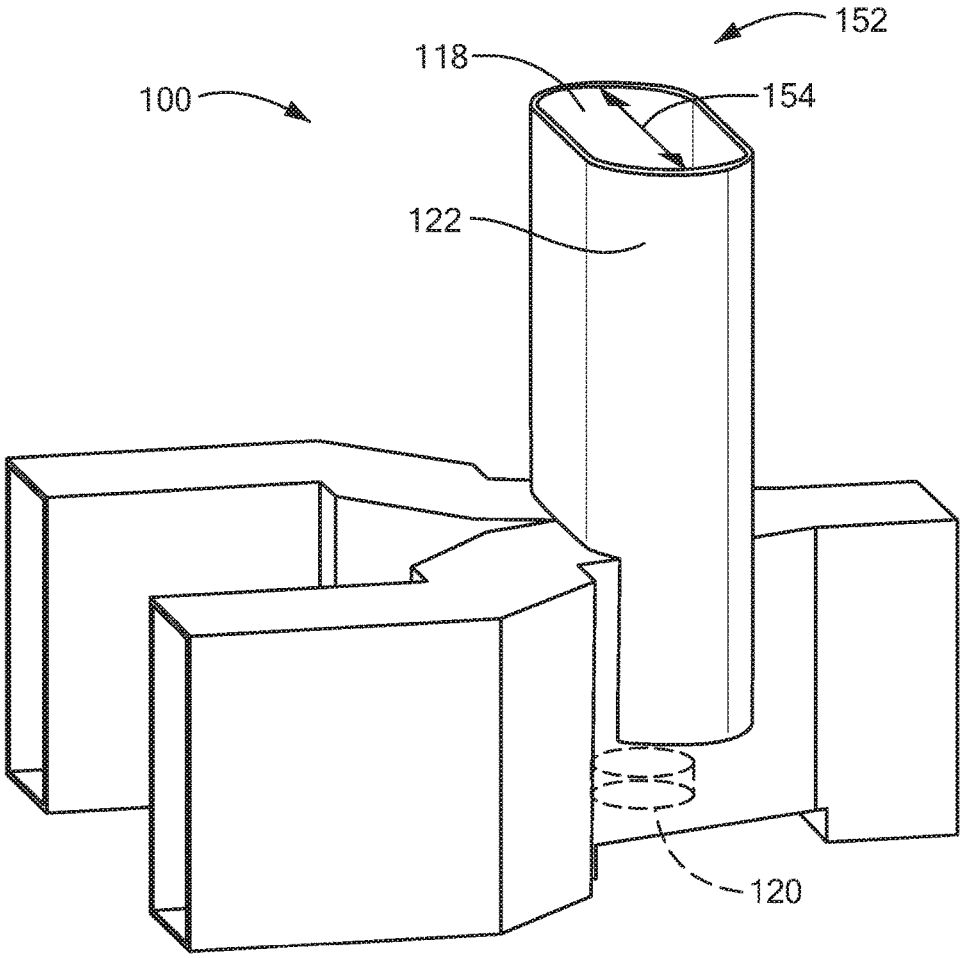
Figure 2E:
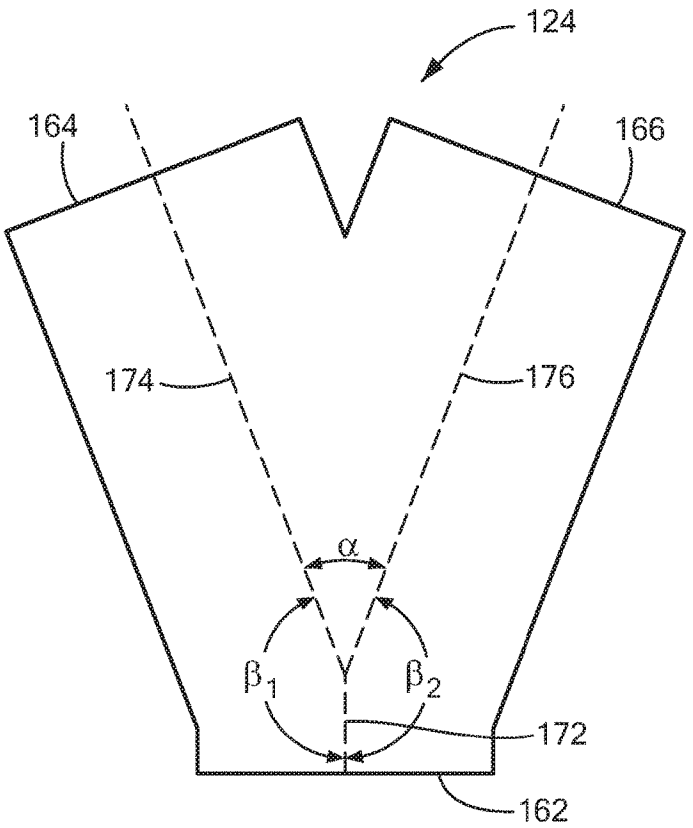
FIG. 2E is a diagram of the Y-split portion of the magic-Y splitter.
Figure 2D:
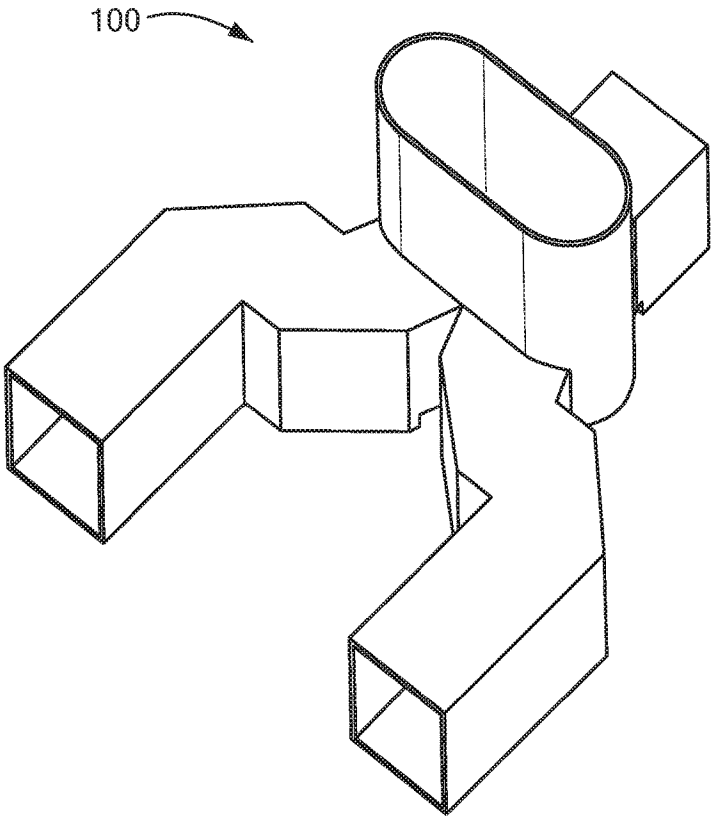
Figure 3A:
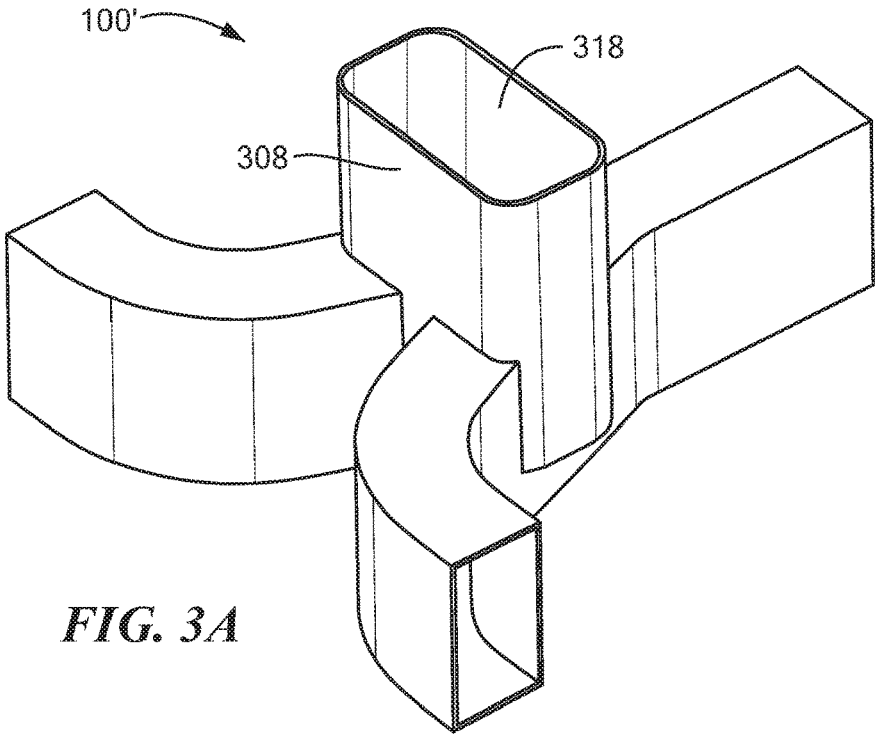
FIGS. 3A and 3B are diagrams of another example of a magic-Y splitter.

Further features to control performance may include whether the waste arm 122 is rounded as shown in FIG. 2C or blocked as shown in FIG. 3A. One of ordinary skill in the art upon reading this description will appreciate that various features can be varied in different combinations to optimize performance.

Figure 3B:
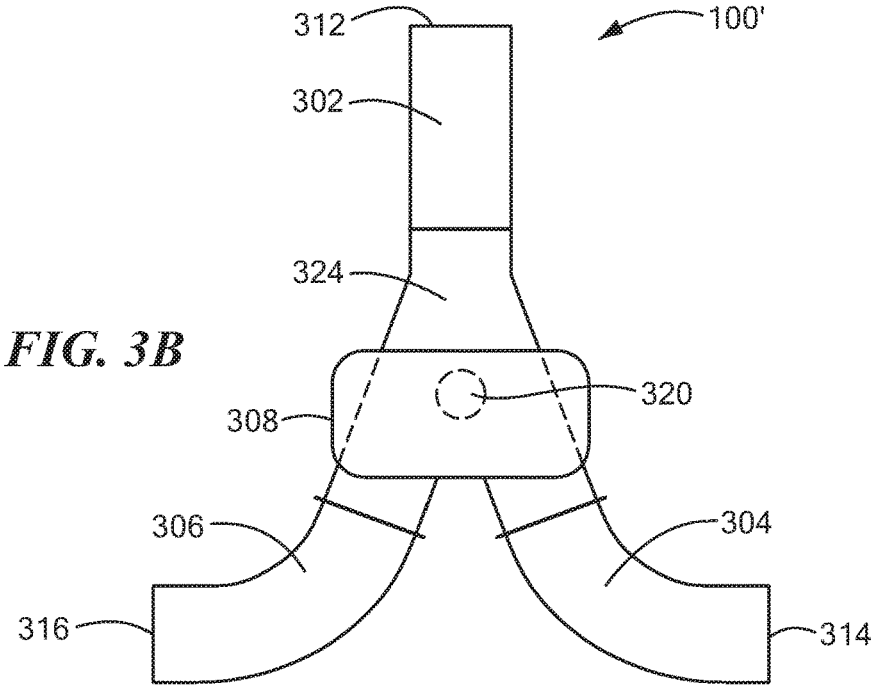
Figure 4A:
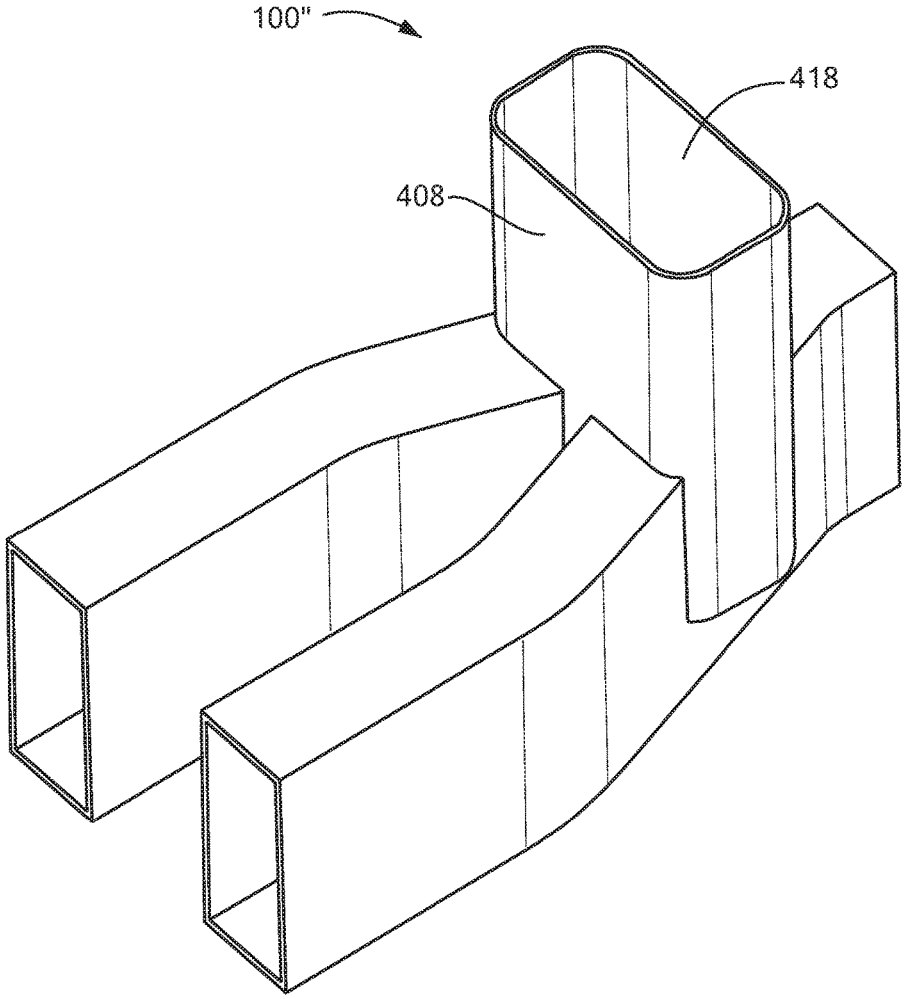
FIGS. 4A and 4B are diagrams of a further example of a magic-Y splitter.
Figure 4B:
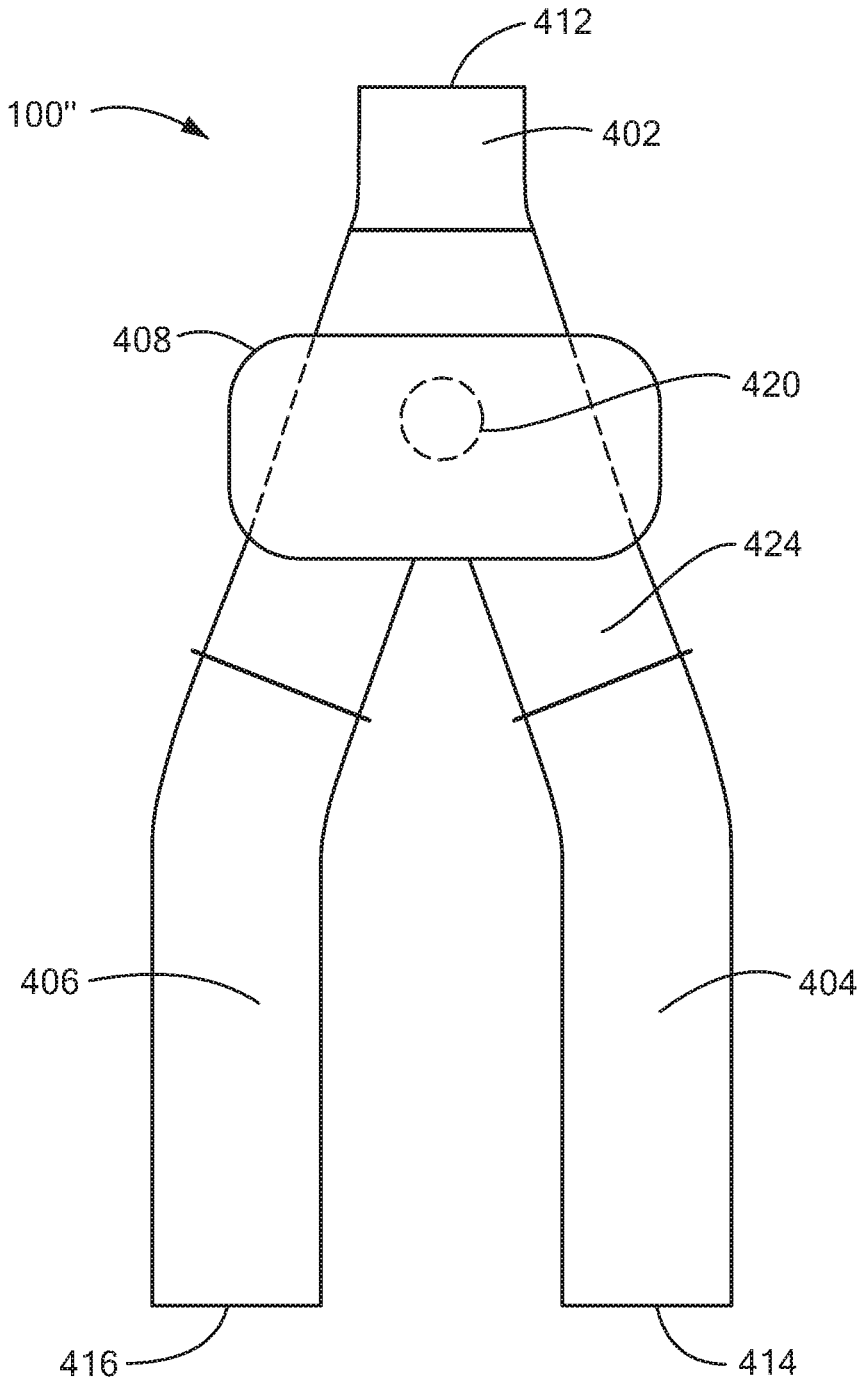

Referring to FIGS. 3A and 3B, another example of the magic-Y splitter is the magic-Y splitter 100'. The magic-Y splitter 100' includes a first arm 302 having a first port 312, a second arm 304 having a first port 314, a third arm 306 having a third port 316, a fourth arm 308 having a fourth port 318, a post 320 and a Y-split portion 324. In this configuration, the second and third arms 304, 306 are curved such that the signals entering or exiting the second and third ports 314, 316 are orthogonal to signals exiting or entering the first port 312.

Referring to FIGS. 4A to 4D, a further example of the magic-Y splitter is the magic-Y splitter 100". The magic-Y splitter 100' includes a first arm 402 having a first port 412, a second arm 404 having a second port 414, a third arm 406 having a third port 416, a fourth arm 408 having a fourth port 418, a post 420 and a Y-split portion 424. In this configuration, the second and third arms 404, 406 are curved such that the signals entering or exiting the second and third ports 414, 416 are parallel to signals exiting or entering the first port 412 like magic-Y splitter 100.

Elements of different embodiments described herein may be combined to form other embodiments not specifically set forth above. Various elements, which are described in the context of a single embodiment, may also be provided separately or in any suitable subcombination. Other embodiments not specifically described herein are also within the scope of the following claims.

What is claimed is:

1. A Y-splitter comprising:
a first arm having a first port;
a second arm having a second port;
a third arm having a third port;
a fourth arm having a fourth port;
a Y-split portion having:
a first end coupled to the first arm;
a second end coupled to the second arm;
a third end coupled to the third arm; and
a fourth end coupled to the fourth arm;
a post having a circular cross-section, said post disposed on a bottom surface of said first arm at a location aligning with a center of the Y-split portion and configured to suppress non-dominant waveguide modes;
wherein the Y-split portion splits a signal from a first signal path from the first port into a second signal on a second signal path and a third signal on a third signal path,
wherein a first angle between the second signal path and the first signal path is greater than 90 degrees, and
wherein a second angle between the third signal path and the first signal path is greater than 90 degrees.

2. The Y-splitter of claim 1, wherein the fourth port is a waste port,
wherein the Y-splitter is a divider,
wherein the first port is an input port and the second and third ports are output ports.

3. The Y-splitter of claim 1, wherein the second arm, the third arm and the Y-split portion form a step.

4. The Y-splitter of claim 1, wherein the Y-splitter is a combiner with the first port is an output port and the second and third ports are input ports.

5. The Y-splitter of claim 1, wherein the first, second and third signal paths are in a first plane.

6. The Y-splitter of claim 5, wherein the first plane is an E-plane.

7. The Y-splitter of claim 6, wherein the fourth arm is in an H-plane.

8. The Y-splitter of claim 1, wherein the splitter floor step at a bottom of the Y-split portion is raised or lowered.

9. The Y-splitter of claim 1, further comprising a load disposed on the fourth port.

10. The Y-splitter of claim 1, wherein the Y-splitter is fabricated in two pieces split along an E-plane.

11. The Y-splitter of claim 1, wherein the second signal exits the Y-splitter at the second port, and wherein the third signal exits the Y-splitter at the third port.

12. The Y-splitter of claim 1, wherein the second signal is isolated from the third signal.

13. A Y-splitter comprising:
a first arm having an input port;
a second arm having a first output port;
a third arm having a second output port;
a fourth arm having a waste port;
a Y-split portion having:
a first end coupled to the first arm;

a second end coupled to the second arm, wherein the second arm, the third arm and the Y-split portion form a step;

a third end coupled to the third arm; and a fourth end coupled to the fourth arm;

a post having a circular cross-section, said post disposed on a bottom surface of said first arm at a location aligning with a center of the Y-split portion and configured to suppress non-dominant waveguide modes, wherein the Y-split portion splits a signal from a first signal path from the input port into a second signal on a second signal path and a third signal on a third signal path, wherein a first angle between the second signal path and the first signal path is greater than 90 degrees, wherein a second angle between the third signal path and the first signal path is greater than 90 degrees, wherein the first, second and third signal paths are in an E-plane, wherein the fourth arm is in an H-plane, and wherein the Y-splitter is fabricated in two pieces split by the E-plane.

14. The Y-splitter of claim 13, wherein the second signal exits the Y-splitter at the second port, and wherein the third signal exits the Y-splitter at the third port.

15. The Y-splitter of claim 14, wherein the second signal is isolated from the third signal.

16. A method comprising:

splitting a first signal into a second signal and a third signal using a Y-splitter, wherein the Y-splitter comprises:

a first arm having an input port;

a second arm having a first output port;

a third arm having a second output port;

a waste arm having a waste port;

a Y-split portion having:

a first end coupled to the first arm;

a second end coupled to the second arm, wherein the second arm, the third arm and the Y-split portion form a step;

a third end coupled to the third arm; and a fourth end coupled to the fourth arm;

a post having a circular cross-section, said post disposed on a bottom surface of said first arm at a location aligning with a center of the Y-split portion and configured to suppress non-dominant waveguide modes; and isolating the second signal from the third signal using the Y-splitter.

17. The method of claim 16, wherein isolating the second signal from the third signal using the Y-splitter further comprises adding a load to the waste port.

* * * * *